US005685129A

United States Patent [19]

Baker

[11] Patent Number: 5,685,129

[45] Date of Patent: Nov. 11, 1997

[54] AUTOMATIC CAN LID BAG SEALER

[75] Inventor: Darryl S. Baker, Beaumont, Calif.

[73] Assignee: Metal Container Corporation, St. Louis, Mo.

[21] Appl. No.: 664,475

[22] Filed: Jun. 14, 1996

[51] Int. Cl.[6] ..... B65B 5/06; B65B 7/10; B65B 39/02; B65B 67/04

[52] U.S. Cl. ..... 53/469; 53/482; 53/254; 53/258; 53/284.7; 53/372.2; 53/375.7

[58] Field of Search ..... 53/443, 469, 473, 53/482, 483, 532, 570, 571, 572, 254, 372.2, 375.5, 459, 258, 284.7, 375.7

[56] References Cited

U.S. PATENT DOCUMENTS

| | | | |
|---|---|---|---|
| 1,979,827 | 11/1934 | Frostad | 53/482 X |
| 1,986,043 | 1/1935 | Carter | 53/482 |
| 2,645,397 | 7/1953 | McCallick et al. | 53/254 |
| 3,971,189 | 7/1976 | Mojden et al. | 53/63 |
| 4,018,031 | 4/1977 | Smaw | 53/284.7 X |
| 4,019,305 | 4/1977 | McGhie et al. | 53/482 X |
| 4,051,965 | 10/1977 | Mojden et al. | 214/16.4 A |
| 4,537,010 | 8/1985 | Mojden et al. | 53/447 |
| 4,537,550 | 8/1985 | Mojden et al. | 414/46 |
| 4,742,669 | 5/1988 | Mojden | 53/500 |
| 4,848,059 | 7/1989 | Muller et al. | 53/254 X |
| 4,979,870 | 12/1990 | Mojden et al. | 414/788.4 |
| 5,005,340 | 4/1991 | Mojden | 53/500 |
| 5,119,617 | 6/1992 | Mojden et al. | 53/500 |
| 5,175,980 | 1/1993 | Chiappe et al. | 53/254 X |
| 5,186,593 | 2/1993 | Tsukada et al. | 413/19 |
| 5,441,382 | 8/1995 | Mojden et al. | 414/798.9 |
| 5,502,956 | 4/1996 | Rompa | 53/284.7 X |

*Primary Examiner*—Horace M. Culver
*Attorney, Agent, or Firm*—Sidley & Austin

[57] ABSTRACT

An apparatus and a method for loading and closing bags or sleeve containers are disclosed. An automated arm with pinchers at one end moves from a resting position to an extended position, grasps the unfilled end of a partially filled sleeve container, and rotates to achieve closure.

31 Claims, 5 Drawing Sheets

AUTOMATIC CAN LID BAG SEALER

FIELD OF THE INVENTION

The invention relates to a novel apparatus and novel method for closing the open, unfilled end of a substantially filled sleeve or bag container. A sleeve container is filled with a predetermined amount of product and positioned in a predetermined location within reach of an automated arm. Opposing pinchers on the automated arm grasp the unfilled portion of the sleeve container. The arm then rotates causing the unfilled portion of the sleeve to roll up.

BACKGROUND OF THE INVENTION

Sleeve containers manufactured from nonrigid materials such as paper, plastic, or foil are particularly well suited for enclosing certain types of products, especially those products having a longitudinal axis that is substantially longer than the height or width of a single product or multiple products stacked for packaging. For example, can lids which can be easily stacked one on top of another are frequently packaged in sleeve containers, which are sometimes simply referred to as bags. Unfortunately, automated systems used for closing sleeve or bag containers heretofore have suffered from several deficiencies. One such system is the automatic bagger manufactured by Fleetwood Systems, Inc. and disclosed in U.S. Pat. No. 4,537,010. This device simply folds the unfilled end of the sleeve over the filled end and secures it with tape. This manner of closure increases the bulk of the sleeve, thus increasing handling costs. Furthermore, both workers and unpackaging machines experience added difficulty when trying to open this sleeve after it reaches its final destination. Sleeve containers are often opened by cutting through the sleeve material. When the Fleetwood machine folds an unfilled end over the filled portion of a sleeve, the thickness of the sleeve material in that particular location is effectively multiplied. Thus, a person or machine trying to cut through the sleeve at this location is hindered by the additional layers of sleeve material.

Another automated sleeve closing device, manufactured by Hokkai Can Co. of Japan, sequentially folds the unfilled portion of the sleeve in a multistep process. The Hokkai apparatus relies on multiple devices that sequentially manipulate the open, unfilled end of the sleeve. One device performs one folding step and then transfers the entire sleeve to a second device which performs a second folding step. The sleeve is then transferred to a third device which performs yet another folding step. In the final step of the bagging process, a separate arm tamps the folded end of the sleeve. The numerous components of the Hokkai apparatus are costly to produce. Additionally, the Hokkai apparatus occupies a large amount of floor space.

The preferred method of closure often depends on the facilities of the plant receiving the sleeve. Typically, a plant with automated facilities for opening sleeve containers will prefer receiving sleeves that have been closed mechanically. Plants that rely on factory workers to open sleeve containers, however, prefer sleeves closed by factory workers.

Consequently, a closing system is needed to provide the flexibility of functioning automatically or allowing human intervention in the closing step. Additionally, a closing system is needed that does not suffer from the disadvantages of the Fleetwood and Hokkai systems.

SUMMARY OF THE INVENTION

A novel apparatus and method provide an economical, space-conscious system for closing sleeve containers.

Additionally, the system provides the flexibility of automated closure or manual closure. A sleeve container is filled by placing the open end of an empty sleeve over a shaped horn. The shaped horn maintains the end of the sleeve in an open position during filling and forms a channel through which product enters the sleeve. A spring clamp pushes up from beneath the horn and presses the bottom of the sleeve between the horn and the clamp to secure the sleeve in place during filling. A predetermined amount of product is then pushed into the open sleeve by a beg loader formed from a rod. When the bag loader fully extends, it pushes the predetermined amount of the product through the channel in the horn and into the sleeve. After the predetermined amount of product has been pushed into the sleeve, the substantially filled sleeve falls, slides, or is conveyed to a predetermined position adjacent to an automated arm. A portion of the sleeve at the open end remains unfilled. This unfilled portion may be less than one inch in length but is usually several inches or even a foot or more in length. The "unfilled end" or "unfilled portion" refers to the continuous portion of the sleeve container which does not contain product and which is located between the opening in the end of the sleeve container and the filled portion of the sleeve container. The filled portion of the sleeve container rests on a support structure, typically a shaped trough or a conveyor belt. The unfilled portion extends at least partially beyond the edge of the support structure.

An automated arm with opposing pinchers or mechanical fingers at one end moves from a resting position to an extended position. Upon reaching the extended position, the opposing pinchers grasp the open end of the sleeve. Then the entire arm rotates at least 180 degrees. The arm may rotate until no excess space remains in the sleeve, i.e., all of the unfilled portion of the sleeve has been rolled up. The arm and the opposing pinchers may pause in this position to facilitate retention of the rolled configuration when the opposing pinchers open. After the opposing pinchers open, the automated arm returns to the resting position.

If the sleeve material has a tendency to unroll, then glue or adhesive may be applied to the surface of the sleeve on the unfilled end or near the juncture of the unfilled and filled parts of the sleeve at any time prior to closure. In one embodiment of the invention a glue applicator applies a spot of adhesive to a first predetermined location on the surface of the unfilled portion of the sleeve or on the filled portion of the sleeve near the juncture of the filled and unfilled portions. When the unfilled end is then closed by being rolled up, the adhesive will secure it in the closed position.

In one embodiment of the invention, the automated arm is capable of simultaneous rotational and translational movement. Upon grasping the sleeve, the automated arm rotates causing the unfilled portion of the sleeve to roll up, preferably in contact with the adhesive to achieve closure. At the same time, the arm moves translationally toward the filled portion of the sleeve. As a result, the filled portion of the sleeve container remains stationary during closure of the open end.

Optionally, the pinchers may contain a heating element that is activated after the pinchers grasp the sleeve. The heating element would be useful for sealing sleeves constructed from materials containing wax or plastic.

The grasping of the unfilled end by the pinchers may be facilitated by exerting a slight pressure along either side of the unfilled sleeve. This slight pressure typically causes the unfilled sleeve end to slightly stiffen so long as the pressure is maintained. The pressure is exerted by opposing pleat compression members that simultaneously compress points along either side of the unfilled sleeve. The size and the shape of the opposing pleat compression members are not critical as long as simultaneous compression on either side of the sleeve facilitates grasping by the pinchers. The pleat compression members work particularly well on sleeve containers having preformed pleats extending longitudinally along either side of the sleeve container. In a preferred embodiment of the invention, the pleat compression member contacts the sleeve container along the preformed pleats while the pinchers grasp the unfilled, open end of the sleeve container by simultaneously squeezing together the top and bottom of the unfilled sleeve.

Another embodiment of the invention allows the operator on the factory floor to convert from automatic sleeve closure to manual sleeve closure simply by turning off the automatic arm with a switch on the control panel. Personnel can stand in close proximity to the invention even when it is operational. Thus, switching from automatic to manual closure does not require the removal or disassembly of any safety equipment. After deactivating the arm through a switch on the control panel, the operator can stand directly across from the deactivated arm. A substantially filled sleeve container is moved to a resting position in front of the automatic arm. The operator simply lifts the sleeve from this position and folds or rolls the open, unfilled portion of the sleeve until the sleeve is effectively closed.

DETAILED DESCRIPTION

Figure 1:
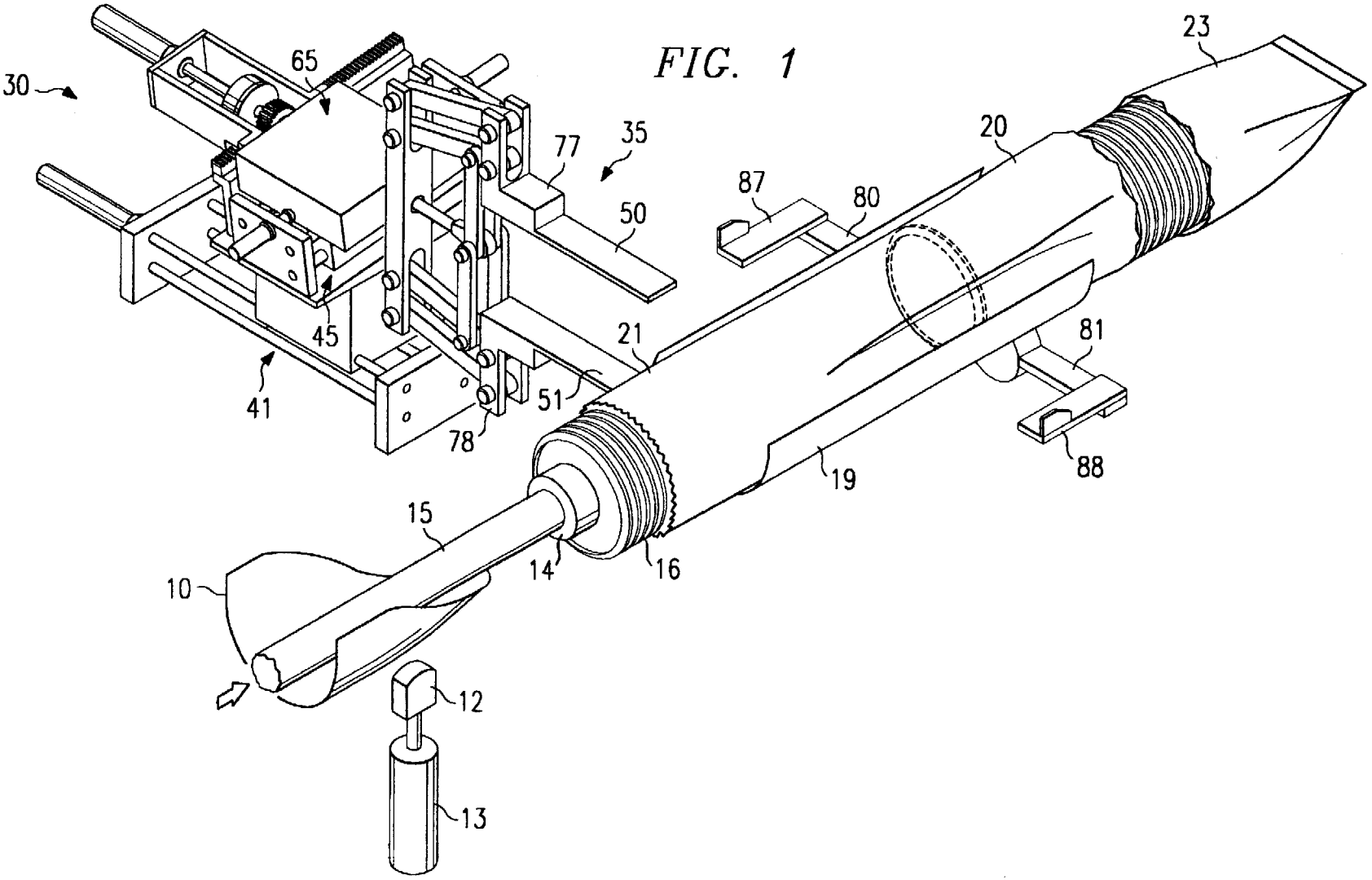
FIG. 1 shows a sleeve loader pushing product into a sleeve, a sleeve trough for holding the loaded sleeve adjacent to the automated arm assembly, and a pleat tuck gripper.

FIG. 1 depicts a sleeve loader assembly. A sleeve container 20 also known as a bag, is first filled with product 16 by positioning the open end 21 of the sleeve 20 over outside perimeter of the horn 10. A spring clamp 12 is retracted by an air cylinder 13 to facilitate placement of the bag on the horn 10. The spring clamp 12 secures the sleeve 20 in place during loading of the sleeve 20 by pushing up from beneath the horn and pressing the bottom of the sleeve between the horn 10 and the clamp 12. A loader rod 15 with a shaped head 14 then pushes a predetermined amount of product 16, i.e., enough product to substantially fill the sleeve container 20, through the conduit formed by the inside surface of the horn 10 and into the open end 21 of the sleeve 20. The sleeve 20 pulls away from the horn 10 and the spring clamp 12 when the pushed product reaches the closed end 23 of the sleeve 20, and the substantially filled sleeve then slides, drops, or is otherwise moved to a predetermined position in a shaped sleeve trough 19 adjacent to an automated arm shown in FIG. 2.

Figure 2:
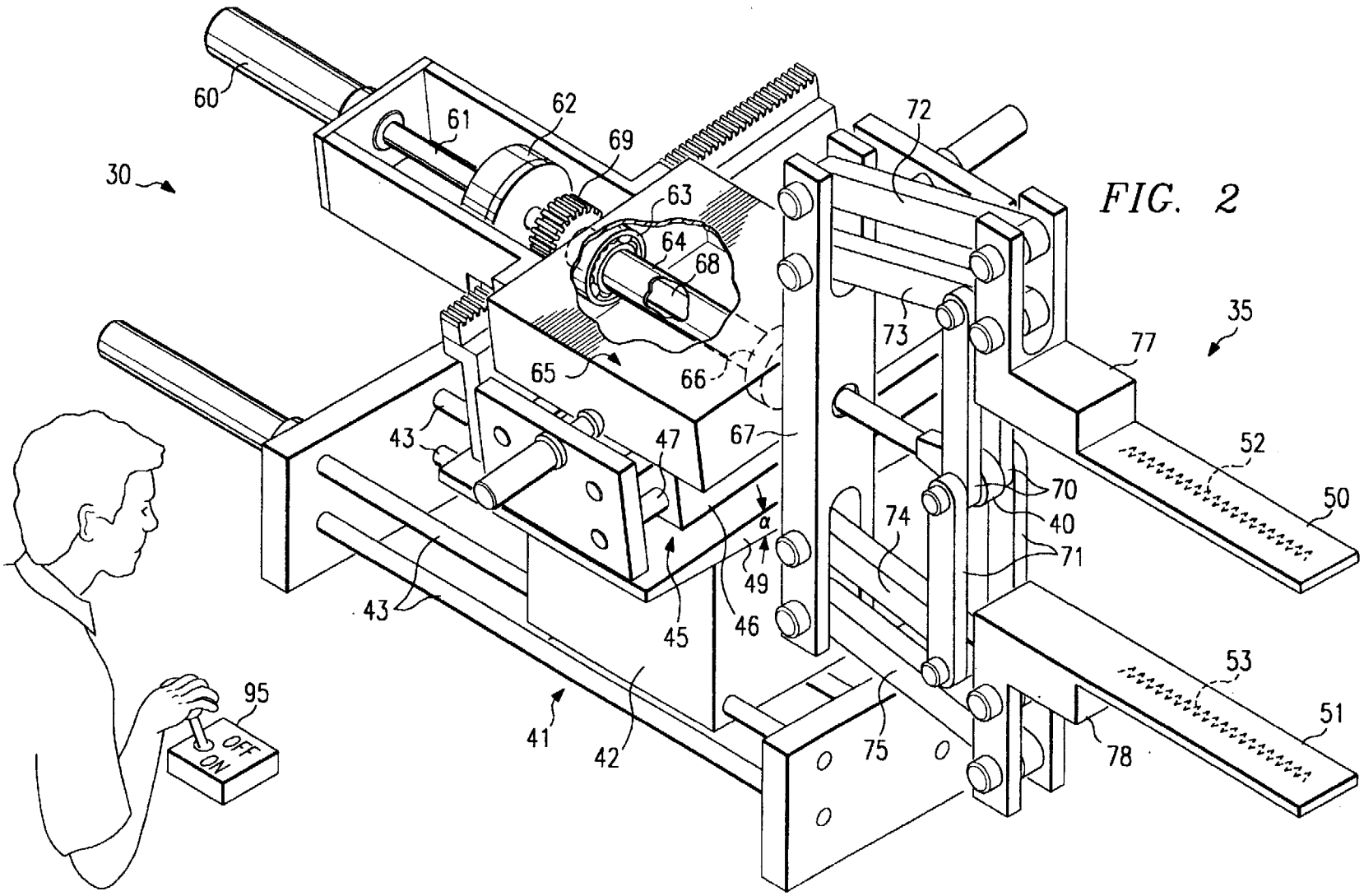
FIG. 2 shows an automated arm assembly for closing a sleeve container.
Figure 3A:
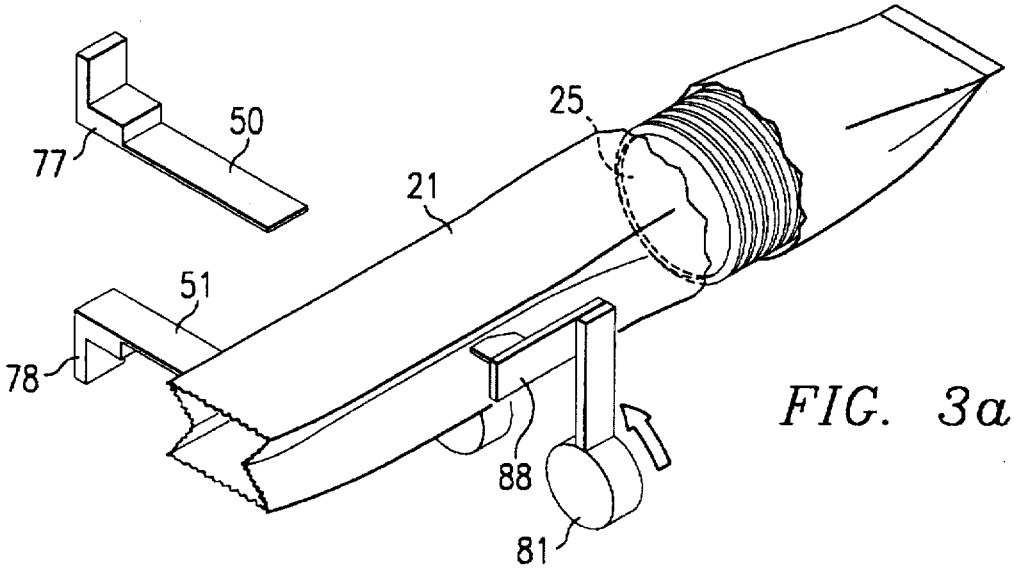
FIG. 3 depicts sequentially an automated arm grasping and rolling up the unfilled end of a sleeve container. In (a), the pleat tuck gripper has slightly compressed the open, unfilled end of the sleeve. In (b), the pinchers have gasped the unfilled portion of the sleeve. In (c), an adhesive applicator has applied glue to the partially rolled sleeve. In (d), the unfilled portion of the sleeve has been substantially rolled up, and the pleat tuck gripper has released from the compression position.
Figure 3B:
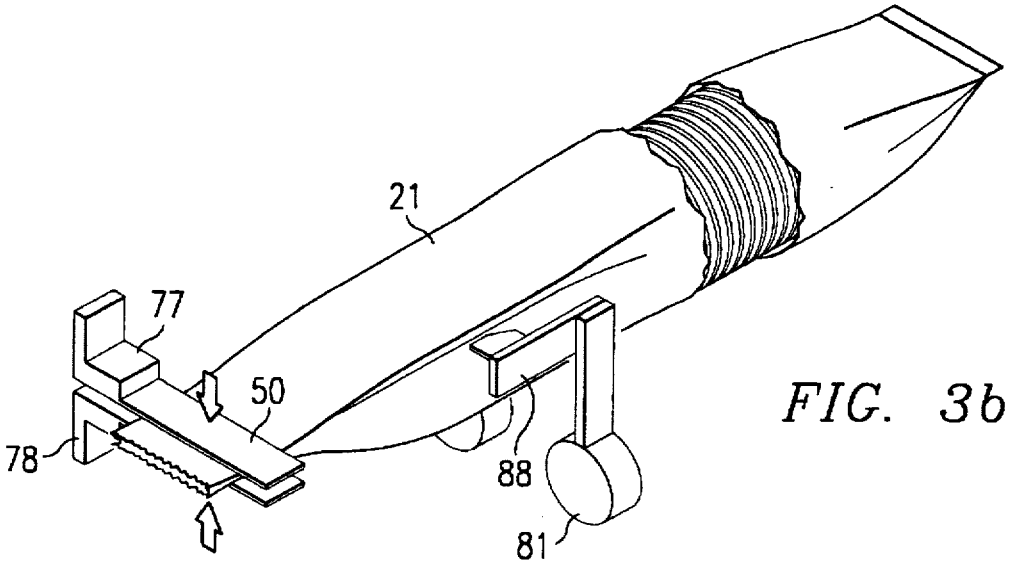
Figure 3C:
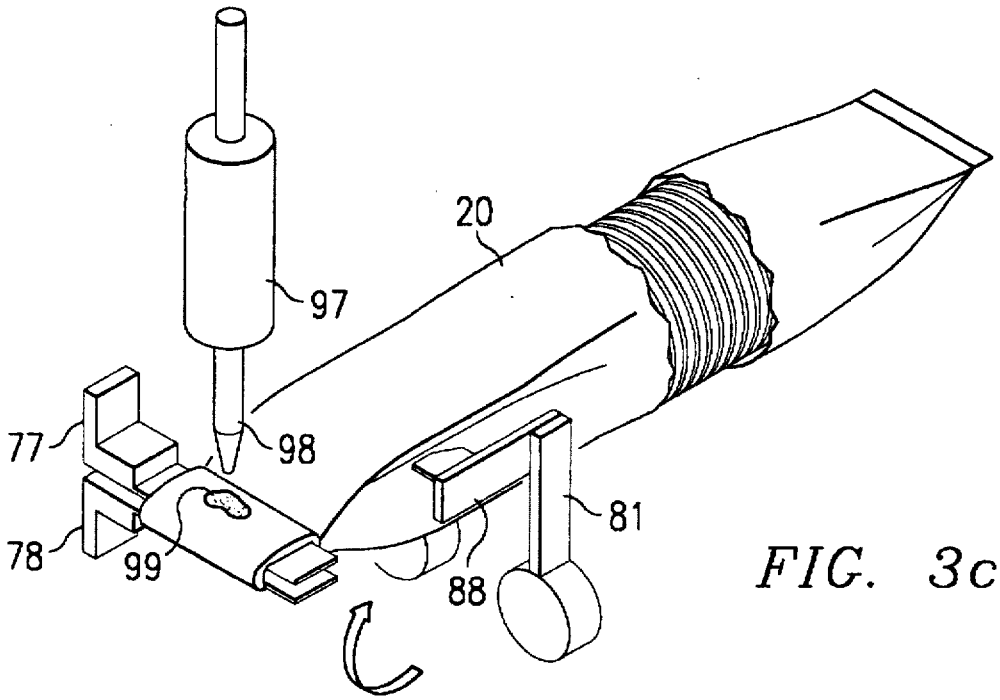
Figure 3D:
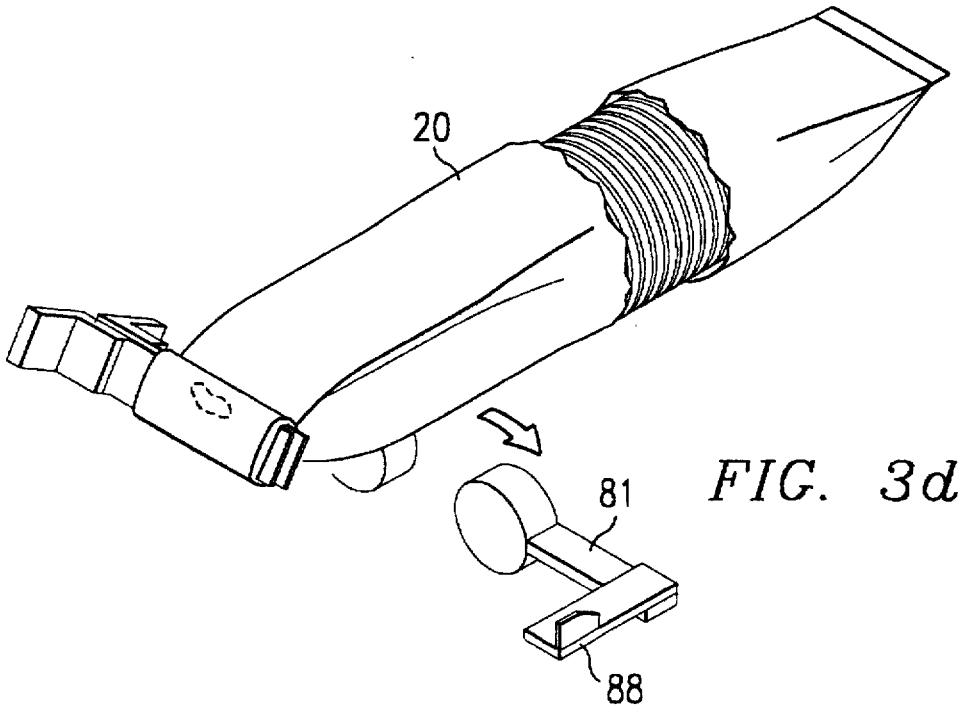

FIG. 2 is a detailed view of an automated arm assembly 30 comprising automated arm 35 mounted on pneumatic slide 45 which in turn is mounted on pneumatic slide 41. Pneumatic slide 45 comprises block 46 which travels along rods 47 extending through said block. Pneumatic slide 41 comprises block 42 which travels along rods 43. When the substantially filled sleeve container 20 is resting in the predetermined position in the sleeve trough 19, the entire automated arm assembly 30 slides forward along the first pneumatic slide 41 from the retracted or resting position to the extended position. This movement is accomplished by block 42 sliding forward along rods 43. Pneumatic slides useful for this application include those manufactured by PHD, Incorporated.

When the arm assembly is in the extended position, pinchers 50, 51 are in position to grasp the open end 21 of the sleeve container 20. The pinchers may optionally contain a heating element shown here as electrical resistance 52, 53 in pinchers 50, 51. The heating element 52 is activated while the pinchers 50, 51 are grasping the unfilled end 21 of the sleeve container 20. The grasping movement of the pinchers is initiated by air cylinder 60 which controls the extension and retraction of air cylinder shaft 61. Air cylinder shaft 61 is connected to bag gripper rod 68 at retaining collar 62. Bag gripper rod 68 extends and retracts in conjunction with the extension and retraction of air cylinder shaft 61. Bag gripper rod 68 extends from retaining collar 62, through shaft 64 in bag gripper block 65, and through leg base 67. Retaining collar 62 prevents rotation of air cylinder shaft 61 when gripper rod 68 and shaft 64 rotate. Axial bearings 63 and 66 facilitate rotation of shaft 64 and gripper rod 68.

The end of bag gripper rod 68 is attached to a linkage mechanism that controls the opening and closing of the pinchers 50 and 51. At the tip of bag gripper rod 68 is cap 40. Numerous linkage mechanisms familiar to those skilled in the art can be used for this purpose.

Figure 6:
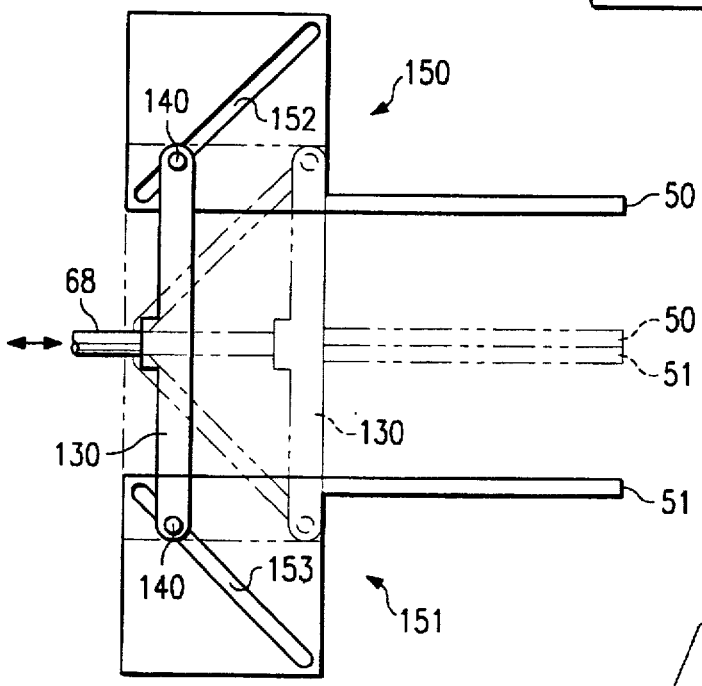
FIG. 6 is an alternative linkage mechanism for opening and closing the pinchers by movement of pins within the slotted finger blocks.
Figure 5:
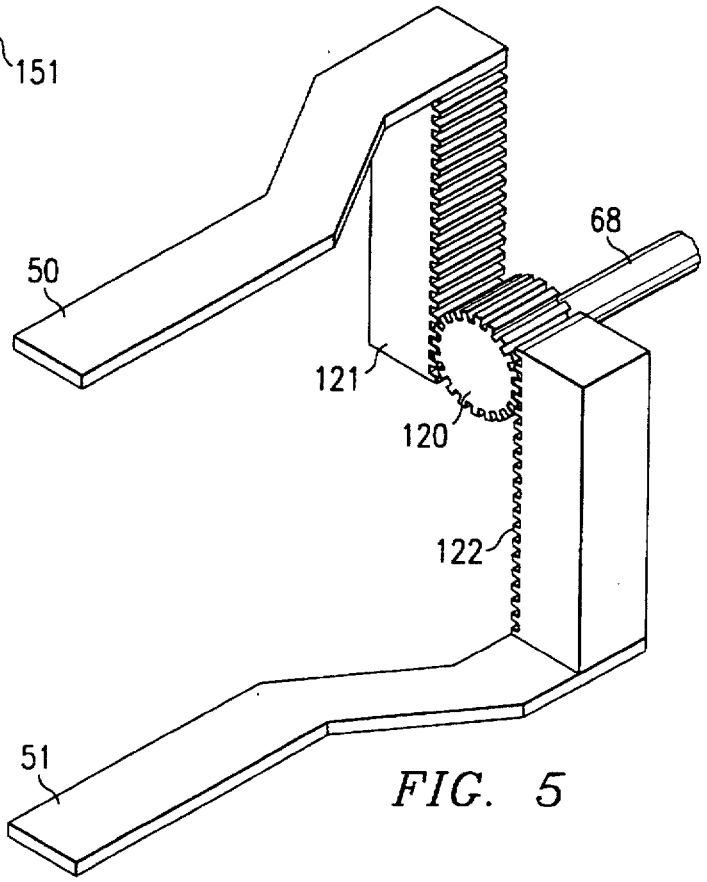
FIG. 5 is an alternative linkage mechanism for opening and closing the pinchers comprising a pinion and racks.

FIGS. 5 and 6 show two such linkage mechanisms for opening and closing pinchers 50, 51. In FIG. 5, gripper rod 68 includes a pinion 120 at one end. Rotation of gripper rod 68 turns pinion 120 which in turn moves racks 121 and 122. Pinchers 50, 51 are attached to racks 121, 122, respectively. Clockwise rotation of the pinion 120 closes the pinchers 50, 51 while counterclockwise rotation of pinion 120 opens the pinchers 50, 51.

In FIG. 6, bag gripper rod 68 is attached substantially perpendicular to the middle of bar 130. Either end of bar 130 is attached by pins 140 to finger blocks 150, 151. Pins 140 can move within the confines of the angled slots 152, 153 on finger blocks 150, 151, respectively. Backward movement of bag gripper rod 68 closes pinchers 50, 51 and forward movement of bag gripper rod 68 opens pinchers 50, 51.

In a preferred embodiment shown in FIG. 2, the end of bag gripper rod 68 is attached to leg links 70 and 71. Legs 72, 73, 74 and 75 extend from either end of leg base 67 and connect leg base 67 and finger blocks 77, 78. Leg link 70 which is rotatably attached at one end to the bag gripper rod 68, is rotatably attached at the other end to leg 73. Pinchers 50, 51 extend outward from each finger blocks 77, 78 respectively.

Figure 4:
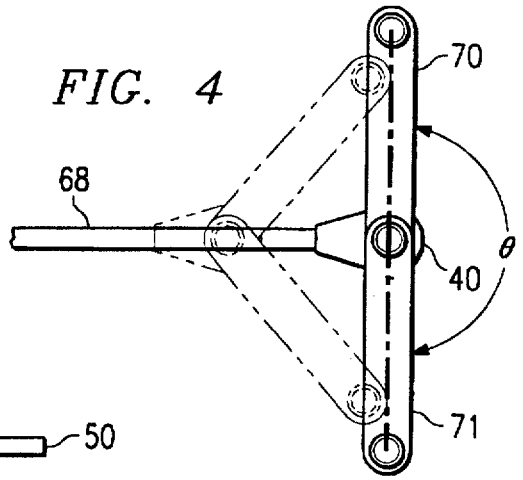
FIG. 4 is a detailed view of the linkage mechanism for opening and closing the pinchers as shown in FIG. 2.

As shown in FIG. 4, fully extending bag gripper rod 68 causes links 70, 71 to form a 180 degree angle 74, thus separating the pinchers 50, 51 from one another. As the gripper rod 68 is retracted toward air cylinder 60, the angle between links 70, 71 decreases until the angle θ becomes zero when the pinchers 50, 51 are completely closed. Preferably, pinchers 50, 51 are substantially parallel to one another in the closed position.

After pinchers 50, 51 close around the open end of the sleeve container 20, gripper rod 68 rotates at least 180 degrees about its longitudinal axis extending through shaft 64. Preferably, the automated arm 35 rolls up the entire unfilled portion of the sleeve, stopping when contact is made with the filled portion of the sleeve. The automated arm 35 may pause in this position for a brief period, several seconds or perhaps even longer, to facilitate closure.

Rotation of gripper rod 68 can be driven by any conventional means. The unfilled, open end of the sleeve 20 can be rolled up to a sealed position without translational movement of the arm 35 if the rotational movement of the arm 35 causes the sleeve 20 to move toward the pinchers 50, 51.

Preferably, however, the sleeve 20 remains essentially stationary while the arm 35 moves both rotationally and translationally. In one embodiment, the beg gripper block 65 of arm 35 is mounted directly on block 46 of a second pneumatic slide 45 which in turn is mounted on block 42 of first pneumatic slide 41. When the pinchers 50, 51 close around the open, unfilled end 21 of the sleeve container 20, the arm 35 moves translationally along this second pneumatic slide 45. This movement is accomplished by block 46 sliding along rods 47. Pinion 69 on gripper rod 68 meshes with gear rack 43 on the second pneumatic slide 42. Pinion 69 rotates as arm 35 moves translationally. Rotation of pinion 69, in turn, rotates bag gripper rod 68 and shaft 64.

Optionally, second pneumatic slide 45 is positioned at a slight angle α 49 to the horizontal. Thus, arm 35 moves slightly upward as it rolls up the unfilled end 21 of the sleeve. The slight upward angle facilitates the formation of a tight, even roll of excess sleeve material. The optimal degree of the angle will depend on the dimensions of arm 35 and its relation to the substantially filled sleeve container 20 resting in the sleeve trough 19. Angles less than 20 degrees, typically less than 10 degrees, and more typically less than 5 degrees, are preferred. When applicant's automated arm assembly is used in conjunction with standard can lid handling components manufactured by Fleetwood Systems, Inc., the preferred angle is four degrees.

After the unfilled end 21 of the sleeve has been rolled up, automated arm 35 returns to its resting position. In the preferred embodiment, the automated arm 35 retracts along pneumatic slide 41 and then moves translationally beck to the original starting position along pneumatic slide 45. The cycle is completed when cylinder 60 and shaft 61 push gripper rod 68 forward to open pinchers 50, 51.

FIG. 1 shows pleat compression members 80 and 81 with contact ends 87 and 88 prior to contacting the unfilled end of the sleeve container. The contact ends 87 and 88 slightly compress substantially filled sleeve container 20 from opposite sides of the sleeve as the sleeve rests in sleeve trough 19. Members 80 and 81 move into the compression position before pinchers 50, 51 grasp the sleeve. The pleat compression members 80, 81 release from the compression position after the pinchers 50, 51 grasp the unfilled portion 21 of the sleeve and before interfering with the rolling action of the unfilled sleeve. The pleat compression members 80, 81 can be powered by electrical, pneumatic or other conventional sources.

FIG. 3 illustrates the sequential steps in the closure or sealing process. In step (a), the substantially filled sleeve container 20 is resting in trough 19 and the automated arm 30 with open pinchers 50, 51 has moved into the extended position. The opposing pleat compression members 80, 81 of the pleating apparatus are in position to slightly press upon the preformed pleats to cause stiffening of the unfilled end 21 of the sleeve. In step (b), the contact ends 87, 88 of the pleat compression members 80, 81 have pressed upon the preformed pleats to cause stiffening. Pinchers 50, 51 have not yet grasped the stiffened end. In step (b), the pinchers 50, 51 have grasped and proceeded to roll up the unfilled end 21 of sleeve 20. Step (c) depicts the application of an adhesive near the juncture of the filled portion 25 of the sleeve and the open, unfilled portion 21 of the sleeve. The pressure activated adhesive applicator 97 has applied glue 99 to the surface of the sleeve through tip 98. As shown in step (d), the pleat compression members 80, 81 have released from the compression position before interfering with the rolling action of the unfilled sleeve.

The movements of the various components and the coordination of movements between components are controlled by automated systems familiar to those skilled in the art. One such system is the Allen-Bradley 5–40 program logic controller. The automated arm assembly 30 can be activated by an on/off switch 95 on the operator's control panel conveniently located on the factory floor, preferably within a few feet of the automated arm assembly 30.

Although the present invention has been described with reference to a presently preferred embodiment, it will be appreciated by those skilled in the art that various modifications, alternatives, variations, etc., may be made without departing from the spirit and scope of the invention as defined in the appended claims.

That which is claimed is:

1. An automated apparatus for closing the open, unfilled end of a substantially filled sleeve container, said apparatus comprising:

an automated arm having at least one end, said end including first and second opposing pinchers, said pinchers movable between a grasping position and an open position, said automated arm being movable between an extended position where said pinchers can grasp the open, unfilled end of said sleeve container, and a resting position, said automated arm being capable of rotation, said rotation of the automated arm causing the open, unfilled end of the sleeve container to roll up in a sealed position.

2. The automated apparatus of claim 1 wherein said automated arm moves translationally toward the filled portion of the sleeve while rotating to roll up the unfilled portion of the sleeve.

3. The automated apparatus of claim 2 wherein said arm moves between said resting position and said extended position along a first pneumatic slide, and wherein said automated arm moves translationally toward the filled portion of the sleeve along a second pneumatic slide.

4. The automated apparatus of claim 3 wherein said end of said arm further comprises a pinion and racks on either side of said pinion, said first and second opposing pinchers extending outward from said racks, the rotation of said pinion moving said racks and opposing pinchers between said grasping position and said open position.

5. The automated apparatus of claim 1 wherein said automated arm further includes a cylinder for generating back and forth movement of a rod in said arm, the rod having a first and second end, the first end of said rod being attached to said cylinder;

and a linkage attached between the second end of said rod and said pinchers, said linkage translating the movement of said rod to open and close said pinchers.

6. The automated apparatus of claim 5 wherein said pinchers extend outward from pincher blocks, each said pincher block including an angled slot; and wherein said linkage comprises a bar having two ends, said bar being attached substantially perpendicular to the second end of said rod, each end of said bar being movably attached to said angled slots in said pincher blocks, said movement of said rod causing said bar to move within the confines of said angled slots, said movement by said bar causing said pinchers to move between said grasping position and said open position.

7. The automated apparatus of claim 5 wherein said linkage comprises a leg base with first and second ends and a central bore; said leg base being rotatably mounted on said rod, said rod extending through the central bore in said leg base; a first and second leg, each leg having a first and second end, said first end of said first leg being rotatably mounted to said first end of said leg base, said first end of said second leg being rotatably mounted to said second end of said leg base; first and second pincher blocks, said first pincher being attached to said first pincher block and said second pincher being attached to said second pincher block; said second end of said first leg being rotatably attached to said first pincher block, said second end of said second leg being rotatably attached to said second pincher block; and first and second leg links, each leg link having a first and a second end, the first end of each said leg link being rotatably mounted to the second end of said rod; the second end of said first link being rotatably attached to said first leg, and the second end of said second link being rotatably attached to said second leg.

8. The automated apparatus of claim 1 further comprising two opposing pleat compression members, each pleat compression member being positioned on either side of said sleeve container, each pleat compression member being movable between a contact position and a resting position, each pleat compression member having a contact end that exerts pressure upon the open, unfilled end of the sleeve container prior to said unfilled portion being grasped by said pinchers, said pressure facilitating grasping of said sleeve by said pinchers.

9. The automated apparatus of claim 1 further comprising a glue applicator for applying adhesive to a predetermined location on the surface of the sleeve prior to the unfilled end of the sleeve being rolled up to a sealed position, said predetermined location being between where the pinchers grasp the unfilled end of the sleeve and the juncture of the filled and unfilled portions of said sleeve.

10. An automated apparatus for closing the open, unfilled end of a substantially filled sleeve container, said apparatus comprising:

an automated arm having at least one end, said end including first and second opposing pinchers, said pinchers movable between a grasping position and an open positions said automated arm movable between an extended position where said pinchers can grasp the open, unfilled end of said sleeve container, and a resting position, along a first pneumatic slide, said automated arm including a cylinder for generating back and forth movement of a rod in said arm, said rod having a first and second end, the first end of said rod being attached to said cylinder; and a linkage attached between the second end of said rod and said pinchers, said linkage translating the movement of said rod to open and close said pinchers;

said automated arm being capable of rotational and translational movement in the extended position when said pinchers have grasped the open, unfilled end of said sleeve, said rotational movement of the automated arm causing the open, unfilled end of the sleeve container to roll up in a sealed position, said automated arm being movable between said resting position and said extended position along a first pneumatic slide, and said automated arm being movable translationally toward the filled portion of the sleeve along a second pneumatic slides; and two opposing pleat compression members, each pleat compression member being positioned on either side of said sleeve container, each pleat compression member being movable between a contact position and a resting position, each pleat compression member having a contact end that exerts pressure upon the open, unfilled end of the sleeve container prior to said unfilled portion being grasped by said pinchers, said pressure facilitating grasping of said sleeve by said pinchers.

11. The automated apparatus of claim 10 further comprising a gear rack on the second pneumatic slide and a pinion mounted on said rod, said pinion meshing with said gear rack, said movement of said arm along the second pneumatic slide causing rotation of said pinion; said rotation of said pinion rotating the automated arm.

12. The automated apparatus of claim 11 wherein said linkage comprises a leg base with first and second ends and a central bore; said leg base being rotatably mounted on said rod, said rod extending through the central bore in said leg base; a first and second leg, each leg having a first and second end, said first end of said first leg being rotatably mounted to said first end of said leg base, said first end of said second leg being rotatably mounted to said second end of said leg base; first and second pincher blocks, said first pincher attached to said first pincher block and said second pincher attached to said second pincher block; said second end of said first leg being rotatably attached to said first pincher block, said second end of said second leg being rotatably attached to said second pincher block; first and second leg links, each leg link having a first and a second end, the first end of each said leg link being rotatably mounted to the second end of said rod; the second end of said first link being rotatably attached to said first leg, the second end of said second link being rotatably attached to said second leg.

13. The automated apparatus of claim 12 wherein said first pneumatic slide is approximately perpendicular to said second pneumatic slide; said second pneumatic slide forming an incline, said translational movement of said arm along said incline facilitating closure of said sleeve.

14. The automated apparatus of claim 13 wherein said angle of incline is less than 20 degrees.

15. The automated apparatus of claim 13 wherein said angle of incline is less than 10 degrees.

16. The automated apparatus of claim 13 wherein said angle of incline is approximately 4 degrees.

17. The automated apparatus of claim 13 further comprising a glue applicator for applying adhesive to a predetermined location on the surface of the sleeve prior to the unfilled end of the sleeve being rolled up to a sealed position, said predetermined location on the surface of said sleeve being between where the pinchers grasp the unfilled end of the sleeve and the juncture of the filled and unfilled portions of said sleeve.

18. The automated apparatus of claim 13 wherein said pinchers include a heating element, said heating element being activated while said pinchers are grasping said sleeve.

19. An apparatus for filling and closing a sleeve container having an open end comprising:

a horn, said horn comprising a curved outer surface that can fit within the open end of said sleeve to maintain the sleeve in an open position during loading, and an inner surface that serves as a conduit for product entering the sleeve;

a spring clamp adjacent to said horn, said spring clamp movable between a compressed position and an operative position where said spring clamp presses against said sleeve mounted on said horn during filling;

a loading rod for pushing a predetermined amount of product through the conduit of said horn and into said sleeve;

a sleeve trough adjacent to said horn, said sleeve trough supporting said sleeve adjacent to an automated arm;

said automated arm having at least one end, said end including opposing pinchers, said automated arm being movable between an extended position, which allows said arm to contact the open end of said sleeve container in said sleeve trough, and a resting position, said automated arm being capable of rotation in the extended position when said pinchers have grasped the open end of said sleeve, said rotation of the automated arm causing the unfilled end of the sleeve container to roll up in a sealed position;

and two opposing pleat compression members, each pleat compression member being positioned on either side of said sleeve container, each pleat compression member being movable between a contact position and a resting position, each pleat compression member having a contact end that exerts pressure upon the open, unfilled end of the sleeve container prior to said unfilled portion being grasped by said pinchers, said pressure facilitating grasping of said sleeve by said pinchers.

20. The apparatus of claim 19 wherein said product comprises can lids.

21. The apparatus of claim 19 wherein said automated arm further includes a cylinder for generating back and forth movement of a rod, the rod having a first and second end, the first end of said rod being attached to said cylinder;

and a linkage attached between the second end of said rod and said pinchers, said linkage translating the movement of said rod thereby opening and closing said pinchers.

22. The apparatus of claim 21 wherein said automated arm includes an activation switch; said switch allowing said arm to operate independently from said sleeve loader.

23. The apparatus of claim 22 wherein said activation switch is mounted on a control panel adjacent to said apparatus for filling and closing a sleeve container and accessible by an operator.

24. A method of closing the open, unfilled end of a substantially filled sleeve container comprising the steps of:

positioning the substantially filled sleeve container in a predetermined location adjacent to an automated sleeve closing apparatus comprising an arm having at least one end, said end including opposing pinchers;

grasping the open, unfilled end of the sleeve container with said pinchers;

rotating said arm at least 180 degrees; and releasing said sleeve from said pinchers.

25. The method of claim 24 further comprising the steps of moving said arm along a first pneumatic slide from a resting position to an extended position prior to said pinchers grasping said sleeve; and moving said arm translationally along a second pneumatic slide toward the filled end of the sleeve while said arm is rotating.

26. The method of claim 25 wherein the step of grasping of said sleeve by said pinchers further comprises the steps of activating an air cylinder in said arm for generating movement of a rod, the rod having a first and second end, the first end of said rod being attached to said cylinder, and the second end being attached to a linkage, the linkage being further attached to the pinchers; and translating the movement of the rod with the linkage to close the pinchers about the sleeve; and wherein the step of releasing said sleeve from said pinchers further comprises the steps of activating said air cylinder to move said rod; and translating the movement of the rod with the linkage to release said sleeve from said pinchers.

27. The method of claim 26, further comprising the step of heating said pinchers to facilitate closure of said open end.

28. The method of claim 26 further comprising the step of simultaneously exerting pressure along points on either side of the unfilled portion of the sleeve, thereby facilitating the grasping of said sleeve with said pinchers, and releasing said pressure prior to interfering with the closing of the sleeve container.

29. The method of claim 26 further comprising the step of applying adhesive to a predetermined location on the surface of the sleeve prior to rotating said arm.

30. A method for filling and closing a sleeve container comprising the steps of:

positioning the open end of the sleeve container around a horn, said horn comprising a curved outer surface that can fit within the open end of the sleeve to maintain the sleeve in an open position during loading, and an inner surface that serves as a conduit for product entering the sleeve;

feeding product into the sleeve by pushing a predetermined amount of product with a sleeve feeder through the conduit of the horn until the product contacts the rear end of the sleeve, causing said sleeve to disengage from said horn and said spring clasp;

moving said sleeve containing said product to a predetermined location adjacent to an automated arm having at least one end, said end including opposing pinchers;

grasping the open end of the sleeve container with said pinchers;

moving the arm translationally toward the filled portion of the sleeve while simultaneously rolling up the unfilled portion of the sleeve; and ceasing translational and rotational movement after rolling up at least enough of the unfilled portion of the sleeve to achieve closure.

31. The method of claim 30 further comprising the step of simultaneously exerting pressure on points along either side of the unfilled portion of the sleeve thereby facilitating the grasping of said sleeve by said pinchers; and releasing said pressure along either side of said unfilled portion of said sleeve before interfering with the closing of said sleeve.

* * * * *

UNITED STATES PATENT AND TRADEMARK OFFICE

CERTIFICATE OF CORRECTION

PATENT NO. : 5,685,129
DATED : November 11, 1997
INVENTOR(S) : Darryl S. Baker

It is certified that error appears in the above-identified patent and that said Letters Patent is hereby corrected as shown below:

Col. 6, lines 61-63, change "opposing pinchers extending outward from said racks, the rotation of said pinion moving said racks and opposing" to --opposing pinchers extending outward from said racks, the rotation of said arm causing rotation of said pinion, the rotation of said pinion moving said racks and opposing--.

Col. 7, line 60, change "open positions" to --open position;--.

Col. 8, line 14, change "pneumatic slides;" to --pneumatic slide;--.

Signed and Sealed this
Fourteenth Day of April, 1998

Bruce Lehman

*Attest:*

BRUCE LEHMAN

*Attesting Officer*

*Commissioner of Patents and Trademarks*